United States Patent [19]

Killeen

[11] Patent Number: 4,458,375

[45] Date of Patent: Jul. 10, 1984

[54] FAN BLADE CLEANER APPARATUS

[76] Inventor: Walter H. Killeen, 210 S. Lopez St., New Orleans, La. 70119

[21] Appl. No.: 440,949

[22] Filed: Nov. 12, 1982

[51] Int. Cl.[3] ..... A47L 25/00

[52] U.S. Cl. ..... 15/236 R; 15/210 A; 15/395

[58] Field of Search ..... 15/236 R, 210 A, 244 R, 15/395, 394

[56] References Cited

U.S. PATENT DOCUMENTS 2,856,625 10/1958 Delacretaz ..... 15/210 A X
4,237,572 12/1980 Larson ..... 15/236 R X

FOREIGN PATENT DOCUMENTS 1086947 10/1967 United Kingdom ..... 15/210 A X

*Primary Examiner*—Chris K. Moore
*Attorney, Agent, or Firm*—Bode & Smith

[57] ABSTRACT

A multiblade centrifugal fan blade cleaner with means abutting the opposing surfaces of adjacent blades of the fan for cleaning the blades.

9 Claims, 6 Drawing Figures

FAN BLADE CLEANER APPARATUS

BACKGROUND OF THE INVENTION

1. Field of the Invention

The present invention relates to apparatus for cleaning fan blades including those of air conditioning and ventilating fans. More particularly, the present invention relates to a pocket-sized apparatus for removing residue built up on the blades of multi-blade wheels of centrifugal fan units typically found in central air conditioning and ventilating fans.

2. General Background

Air conditioning and ventilating units including residential, commercial and industrial units, typically use centrifugal fans which consist of a wheel with blades at its rim, the whole rotating within a housing. The blades are typically forward-curved blades which have the tip inclined in the direction of fan rotation for compactness for a given air delivery and static pressure and for operating at lower tip speed and thus apt to be quieter. In operation, however, a residue of lubricating oils, dust and other particulate matter will inevitably build up on the concave or inside surface of the blades thereby reducing the efficiency of the unit, often by 50% or more. To maintain efficiency therefore, it is necessary to regularly service the fan and particularly to remove the residue built up.

Various devices and methods are well known for cleaning fan blades, such devices include wire brushes, compressed air and highly pressurized water.

Many of these devices suffer in that they require bulky and heavy equipment such as hoses and compressor units or a readily available water supply. Further, devices such as brushes are not designed to fit snugly between fan blades and therefore do not effectuate a thorough cleaning of the blade surfaces.

GENERAL DESCRIPTION OF THE PRESENT INVENTION

The present invention provides a hand-held, pocket-sized apparatus to effectively clean the blades of a multi-blade centrifugal fan, particularly found in air conditioning and ventilating units.

The present invention provides a fan blade cleaner apparatus which comprises a thin elongated member having a substantial portion thereof providing a handle at one end. The other end of the member is provided with a curved head portion which is substantially banana-shaped. Extending between the handle portion and curved head portion and integral to both is a neck portion defining a tapered U-shaped notch. The curved head portion is provided with concave and convex surfaces of different curvature to adapt to the curvatures of opposing faces of adjacent fan blades of a centrifugal fan to clean the blades by the movement of the apparatus parallel to and across the blade surfaces. With the present invention no power source is required.

The present invention provides an easy to operate device able to clean fan blades merely by inserting it between the blades, rotating it until it fits snugly between two adjacent blades and moving it along the blades' surfaces at least one time.

It is an object of the present invention to provide a simple apparatus for cleaning the blades of multi-blade fans, particularly centrifugal fans widely used in air conditioning and ventilating units.

It is a further object of the present invention to provide a fan blade cleaner with the advantage of being pocket-sized for ease of accessibility and availability.

It is a further object of the present invention to provide a fan blade cleaning apparatus having intimate contact with the blades of a multi-blade fan to provide highly effective cleaning of the blades.

It is a further object of the present invention to provide a fan blade cleaning apparatus which is easy to operate requiring that it only be run across the surface of the blade to be cleaned.

It is a further object of the present invention to provide a fan blade cleaning apparatus which is easy and inexpensive to construct and maintain.

Other objects and further scope of applicability of the present invention will become apparent from the detailed description given hereinafter; it should be understood however that the detailed description, while indicating preferred embodiments of the present invention is given by way of illustration only, since various changes and modification within the spirit and scope of the invention will become apparent to those skilled in the art from this detailed description.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and, wherein.

DETAILED DESCRIPTION OF THE PREFERRED EMBODIMENT

Figures 1, 2, 3, 4, 5, 6:
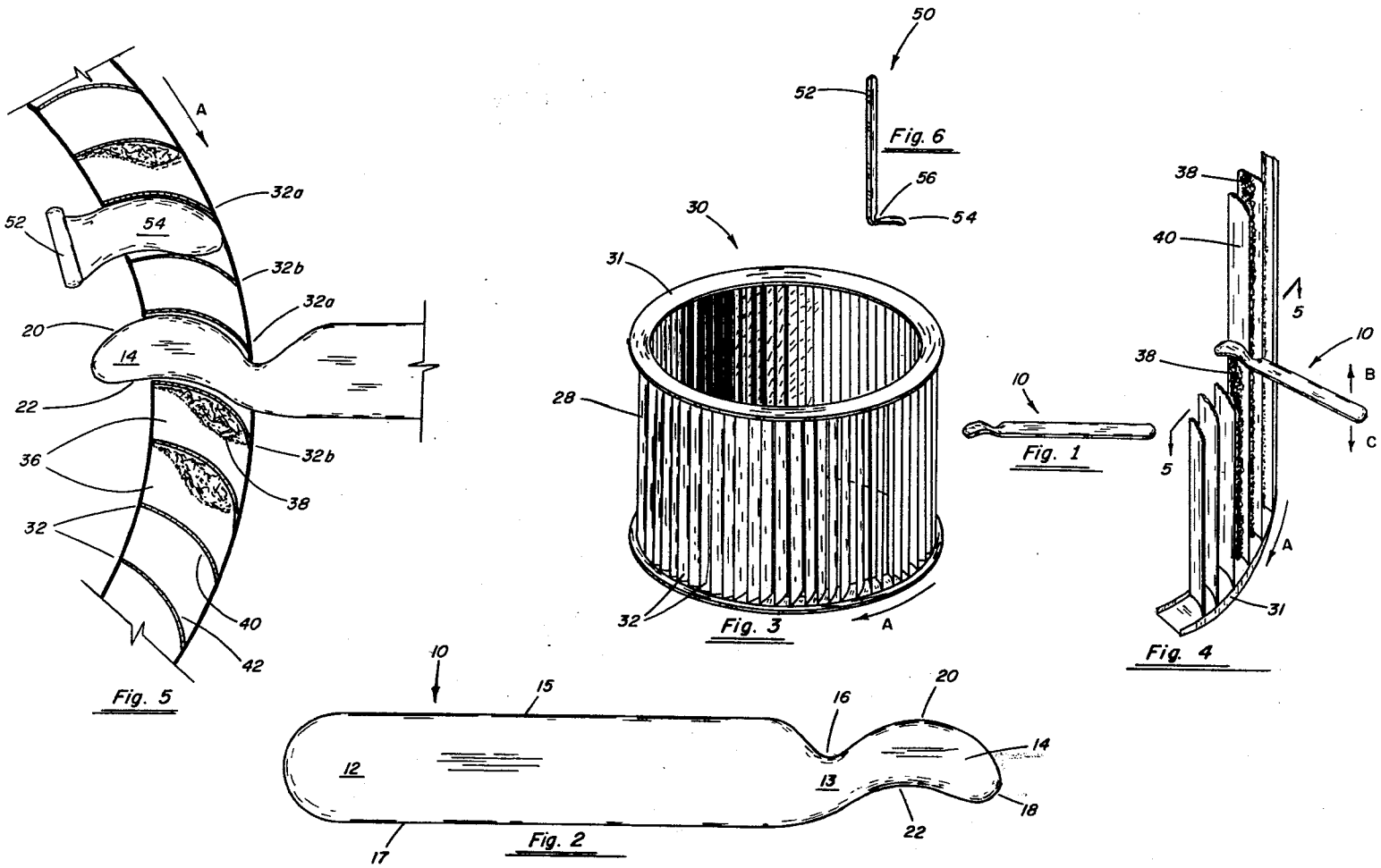
FIG. 1 is a perspective view of the preferred embodiment of the apparatus of the present invention.
FIG. 2 is a top plan view of the preferred embodiment of the apparatus of the present invention.
FIG. 3 is a perspective view of a typical multi-blade wheel for a centrifugal fan unit.
FIG. 4 is a fragmentary view of the multi-blade wheel of FIG. 3 with the apparatus of the present invention inserted for use.
FIG. 5 is a fragmentary plan view of the apparatus as shown in FIG. 4 taken along line 5—5 and with the alternate embodiment of the present invention inserted for use.
FIG. 6 is a perspective view of an alternate embodiment of the apparatus of the present invention.

Air conditioning and ventilating units typically use a centrifugal fan 30, as illustrated in FIG. 3, which consists of a wheel 28 provided with blades 32 at its rim 31, the whole rotating within a housing shaped like a scroll (not shown). Blades 32 are typically forward-curved blades, as best seen in FIG. 5, which have the tip inclined in the direction of fan rotation, as illustrated by arrow A, for performance characteristics. The forward-curved blade fan provides for compactness for a given air delivery and static pressure and operates at lower tip speed and is therefore, apt to be quieter than other types of blades.

In operation in an air conditioning or ventilating system, a residue 38 of lubricating oil, dust and other particulate matter inevitably builds up primarily on the concave blade surfaces 40 of blades 32 reducing the efficiency of the unit, often by 50% or more. (While some particular matter may build up on convex blade surfaces 42 of blades 32, the amount in insignificant due to the nature of the air flow through the depth of void or space 36). To maintain the efficiency of the unit therefore, it is necessary to clean the blades by removing residue 38 which has built up.

FIGS. 1 and 2 best illustrate the preferred embodiment of the apparatus of the present invention generally designated by the numeral 10 which is a hand-held apparatus to effectively clean blades 32 of multi-blade centrifugal fan 30 shown in FIG. 3. Fan blower cleaner apparatus 10 is a thin elongated member having at one end a substantial portion 12 of uniform width provided as a handle. At the other end of the member is provided curved head 14. Neck portion 13, defining tapered U-shaped notch 16, extends integrally from handle 12 to curved head 14. Further, tapered U-shaped notch 16 extends integrally from upper surface 15 of handle 12 to integrally form outer, curved or convex surface 20 of head 14 at the end opposite handle 12 of the elongated member which is blade cleaner apparatus 10. A second inner, curved or concave surface 22 extends from lower surface 17 of handle member 12 to tip 18 where it joins with outer curved or convex surface 20 to form head 14.

As best seen in FIG. 1, curved head portion 14 is integral with handle 12 being joined thereto by neck portion 13 which defines tapered U-shaped notch 16. Further, curved surfaces 20 and 22 are convex and concave surfaces respectively, so that head 14 can be defined as substantially "banana-shaped".

The radii of curvature of concave surface 22 is greater than that of convex surface 20 to allow insertion and operation of apparatus 10 which will be described further below. The centers of curvature of blade surfaces 20 and 22 are also offset to form the complex shape of head 14 so that head 14 may snugly abut concave blade surface 40 of blade 32*a* over at least half its length and provide at least tangential or point contact with the opposing surface 42 of adjacent blade 32*b* as shown in FIG. 5. In the conventional centrifugal fan 30, illustrated in FIG. 3, the center of curvature of each blade 32 is offset from that of the adjacent blade for performance purposes and thus the complex shape of head 14 described above.

Returning to FIG. 5, convex surface 42 of blade 32*b* is opposite concave surface 40 of the adjacent blades 32*a*. In this way when head 14 of apparatus 10 is inserted longitudinally between adjacent blades 32*a* and 32*b* and rotated to the horizontal, as shown in FIGS. 4 and 5, its concave surface 22 will establish at least point contact with convex surface 42 of blade 32*b*. Simultaneously, outer curved or convex surface 20 of head 14 and apparatus 10 will substantially abut (over at least half its length) concave blade surface 40 so that head 14 is snugly secured in space 36, the space defined as the void between adjacent blades 32 of fan 30.

With convex surface 20 of head 14 in substantial abutment with concave surface 40 of blade 32*a*, convex surface 20 is also in contact with residue 38 built up on the concave surface of blade 32*a*. Also with concave surface 22 in at least point contact with convex surface 42 of blade 32*b*, head 14 is held firmly in the horizontal position by the frictional forces involved. By imparting force on handle 12 in the direction of either arrows B or C, convex surface 20 of head 14 will remove residue 38 from concave surface 40 of blade 32*a* by a scraping action. In this manner the concave surfaces 40 of blades 32 can be cleaned seriatim with relative ease and dispatch.

Apparatus 10 can be inserted into void 36 from either the exterior or interior of fan 30 depending on the given application. To insert head 14 properly into void 36 between adjacent blades 32*a*, 32*b* apparatus 10 is rotated slightly either clockwise or counter-clockwise from the position shown in FIG. 4. In this way head 14 due to the differing radii of curvature of surfaces 20,22 can be aligned so that notch 16 assumes a position slightly removed from rim 31. Then apparatus 10 is rotated back to the horizontal position for the snugly abutting fit illustrated in FIG. 5.

Exact radii are not provided herein for surfaces 20,22 of head 14 so as to compensate for variations in blade pitch and curvature in different applications of apparatus 10. However, it is to be understood that within limits (e.g. refrigeration, residential air conditioning, commercial air conditioning, etc.) a universal configuration of head 14 can be made as exemplified in FIG. 2. In FIG. 2 apparatus 10 is, for the convenience of the reader, drawn to actual size and substantially actual curvature. It should be again understood however, that head 14 may be varied in shape by different manufacturers to accommodate differently pitched blades of centrifugal fans.

It should also be understood that the apparatus 10 of the present invention may be used with any type of multi-blade fan but is preferred for use with forward curved blades of centrifugal air conditioning and ventilating fans as illustrated in FIGS. 3, 4 and 5.

Apparatus 50 shown in FIG. 6, is an embodiment distinguished from that shown in FIG. 1 by the substantially 90 degree angle shown between elongated handle portion 52 and head portion 54. This substantially 90 degree angulation creates notch 56. This embodiment 50 of the present invention allows for easy access to fan blades 32 which would be difficult to reach using the embodiment illustrated by the numeral 10 (e.g. direct drive blower units). In the alternate enbodiment, apparatus 50 can be inserted between blades 32 only from the interior portion of fan 30 as illustrated in FIG. 5 whereas the embodiment illustrated by apparatus 10 can be inserted from either the exterior or interior of fan 30 as described above. Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A fan blade cleaning apparatus for scraping clean the blades of fans having multiple forward-curved blades of equal curvature but in non-parallel spaced relation, said apparatus comprising:

a. an elongated substantially flat handle portion;

b. means for scraping clean the concave surfaces of said fan blades wherein said means abuts opposing surfaces of adjacent blades of said fan under all conditions of operation and further comprises a substantially flat curved member having:

i. a convex scraping surface for abutting the concave surface of a first blade of said multiple blade fan; and ii. a concave surface having a radius of curvature greater than the radius of curvature of said convex surface of said scraping means, for abutting the convex surface of a second blade of said fan, said first and second fan blades being adjacent blades of said multiple blade fan; and c. a flat neck portion intermediately disposed between and integrally connecting said handle portion and said means for scraping clean the concave surfaces of said fan blades.

2. The apparatus of claim 1 wherein the curvature of said convex surface of said fan blade cleaning apparatus is substantially identical to the curvature of said concave surface of said blades of said multiple blade fan.

3. The apparatus of claim 1 wherein at least half of the length of said convex surface of said fan blade cleaning apparatus is in contact with said concave surface of said first blade of said multiple blade fan under all conditions of operation.

4. The apparatus of claim 1 wherein less than half the length of said concave surface of said fan blade cleaning apparatus is in contact with said convex surface of said second blade of said multiple blade fan.

5. The apparatus of claim 1 wherein said concave surface of said fan blade cleaner is in tangential contact with said convex surface of said second blade of said multiple blade fan.

6. The apparatus of claim 1 wherein said multiple blade fan is a centrifugal fan.

7. A fan blade cleaning apparatus for scraping clean the blades of fans having multiple forward-curved blades of equal curvature but in non-parallel spaced relation, said apparatus comprising:

a. an elongated substantially flat handle portion;

b. means for scraping clean the concave surfaces of said fan blades wherein said means in operation complimentarily abuts opposing surfaces of adjacent blades of said fan and further comprises a substantially flat curved member having its longitudinal axis substantially perpendicular to the longitudinal axis of said handle portion and having:

i. a convex scraping surface for abutting the concave surface of a first blade of said multiple blade fan; and ii. a concave surface having a radius of curvature greater than the radius of curvature of said convex surface of said means for scraping, for abutting the convex surface of a second blade of said fan, said first and second blades being adjacent to blades of said multiple blade fan; and c. an angulated neck portion intermediately disposed between and integrally connecting said handle portion and said means for scraping clean the concave surfaces of said fan blades is substantially perpendicular relation.

8. The apparatus of claim 7 wherein said curved head portion is substantially banana-shaped.

9. The apparatus of claim 7 wherein said fan is a centrifugal fan.

* * * * *